United States Patent [19]

Deforeit

[11] 4,149,440

[45] Apr. 17, 1979

[54] POLYPHONIC COMPUTER ORGAN

[76] Inventor: Christian J. Deforeit, 202, rue des Joncs Marins, 91620 La Ville du Bois, France

[21] Appl. No.: 777,445

[22] Filed: Mar. 14, 1977

[30] Foreign Application Priority Data

Mar. 16, 1976 [FR] France ..... 76 07419

[51] Int. Cl.[2] ..... G10H 1/02

[52] U.S. Cl. ..... 84/1.01; 84/1.12; 84/1.21; 84/1.22

[58] Field of Search ..... 84/1.01, 1.03, 1.11, 84/1.12, 1.19, 1.21, 1.22, 1.24

[56] References Cited

U.S. PATENT DOCUMENTS

| | | | |
|---|---|---|---|
| 3,610,799 | 10/1971 | Watson | 84/1.01 |
| 3,809,786 | 5/1974 | Deutsch | 84/1.01 |
| 3,809,790 | 5/1974 | Deutsch | 84/1.01 |
| 3,823,390 | 7/1974 | Tomisawa et al. | 84/1.01 |
| 3,854,366 | 12/1974 | Deutsch | 84/1.24 |
| 3,875,842 | 4/1975 | Kmetz | 84/1.01 |
| 3,910,150 | 10/1975 | Deutsch et al. | 84/1.03 |
| 3,913,442 | 10/1975 | Deutsch | 84/1.19 |
| 3,992,970 | 11/1976 | Chibana et al. | 84/1.11 |
| 4,033,219 | 7/1977 | Deutsch | 84/1.03 |

*Primary Examiner*—Robert K. Schaefer
*Assistant Examiner*—Vit W. Miska
*Attorney, Agent, or Firm*—Oblon, Fisher, Spivak, McClelland & Maier

[57] ABSTRACT

A polyphonic electronic musical instrument in which the complex signal delivered by the instrument is made up of successive samples.

Each sample in the complex signal is the sum of the samples of the different harmonics of the various notes played, at the corresponding amplitudes. A device for scanning the keys and pedals comprises two or three counters which operate in association with one another to detect the number (i) of each played note out of the 12 or 13 notes in an octave, and also detect the number of the corresponding octave (n) and successively calculate the various samples of the harmonics of the note (i, n). The set of operations is performed in a sufficiently short time to produce notes of 6–10 kHz.

14 Claims, 10 Drawing Figures

POLYPHONIC COMPUTER ORGAN

BACKGROUND OF THE INVENTION

The invention relates generally to musical instruments, and more particularly to polyphonic electronic musical instruments using a substantially numerical method. The instruments in question are e.g. electronic organs, electronic accordions or any other instrument, with or without a keyboard, for synthetically producing musical sounds by electronic actuating means.

In prior-art polyphonic instruments, the sounds are produced by sets of oscillators associated with filter and shaping circuits for producing sinusoidal sounds at the fundamental frequency of the played note, together with the various harmonics in the sound of the note as produced by the instrument which is to be imitated. The oscillator outputs are mixed, with suitable amplitude weighting to obtain a complex wave form. Good results are obtained only if there is a large number of oscillators and of filter and shaping circuits. Consequently, the number of electric contacts associated with each key must also be large and the wiring of the circuits and contacts is complex. It is also difficult to obtain a complex wave form which is identical for each played note.

Since the instrument does not imitate only a single conventional instrument but has to simulate a number of sets of instruments preselected by switches, numerous different filter and weighting circuits are required together with numerous set switches, which further complicates the wiring.

After the synthesis has been made, the attack, sustain and extinction periods of each note have to be shaped so as to simulate the mechanical delay inherent in the beginning or end of a sound produced e.g. by an organ pipe and bellows, or the sudden attack of the high-rank harmonics in the case of a piano, the subsequent extinction being variable for each harmonic of the sound. Usually, these attack and extinction coefficients are produced by charging and discharging a capacitor providing a voltage whih increases or decreases in logarithmic manner. In that case, the amplitude of the resulting note has to follow the variations in the increasing or decreasing voltage. This method limits the choice of the attack and extinction characteristics, which differ in both time and frequency in the case of practically all the instruments which it is desired to imitate. Furthermore, the use of percussion circuits for obtaining these effects results in considerable extra complexity in wiring and the circuits, particularly when a polyphonic effect is required.

In some prior-art electronic organs, numerical circuits are used to produce sounds. The waves to be reproduced are stored in the form of numerical samples which are read at variable speeds to reproduce all the notes played by the instrument. A number of wave forms can be stored in a number of stores to simulate a number of sets of different instruments.

In other prior-art organs, samples of a sinusoidal function are stored instead of the complex wave form to be reproduced by the instrument. In that case, the complex sound of an instrument must be obtained by producing samples of the fundamental note and of the harmonics and adding them at suitable amplitudes before converting them to analog signals.

Hitherto, these numerical methods have been difficult to apply to truly polyphonic instruments and, in order to pay several notes simultaneously, it has been necessary to multiply the number of circuits, since these can play only a single note at once. Consequently, control of the circuits by the manual keys or pedals becomes a complex operation requiring numerous circuits and complex, expensive wiring. Furthermore, in order to obtain the various kinds of sound, the number of stores and amplitude control circuits has to be multiplied by the number of different notes which can be played simultaneously.

SUMMARY OF THE INVENTION

The musical instrument according to the invention is a truly polyphonic instrument which is not subject to the limitations of the prior art. Its operation is completely numerical and it can produce samples of all the frequencies of all the played notes, add them and convert the results to analog signals at a sufficiently high rate for properly transmitting frequencies of the order of 6 to 10 kHz.

The musical instrument according to the invention can use a large number of keys and pedals without complicated wiring, since only a few tens of connections have to be made. It can produce a large number of harmonics in addition to the fundamental note corresponding to each selected key, and the amplitude of each harmonic can be chosen. In addition, the attack and extinction characteristics of each harmonic component of the sounds produced can be chosen. Accordingly, the instrument can produce any wave form and reproduce any timbre of most instruments. It can also, like those instruments called synthesizers, produce timbres which do not correspond to any existing instrument. As before, the reproduction can be polyphonic.

The musical instrument according to the invention uses a small number of circuits which are completely numerical and consequently suitable for integrated components. Thus, a set of circuits occupies a small space and the assembly and wiring operations can be greatly reduced. In addition, all or part of the instrument can be incorporated in a single circuit.

The instrument according to the invention comprises a device which scans the manual keyboard or keyboards and the pedal board, if any, and, for each selected note, calculates the sample of the fundamental frequency and of the harmonics, with their respective amplitudes. All the samples of all the preselected harmonics of all the played notes are calculated and added together during a repetition period which is substantially less than the half-cycle of the highest-frequency harmonic which the instrument can produce.

This speedy calculation is obtained by using a special method of scanning the manual and pedal keyboards and the set-selection means. If a note is not selected on a manual pedal keyboard, no sample is calculated for this note. This greatly reduces the total time for calculating each sample of the final complex signal.

As can easily be seen, the number of notes played simultaneously is not likely to exceed 11 or 12, whereas the instrument can have more than 100 keys and pedals. If the number of harmonics chosen for each played note is e.g. 16, the maximum number of samples to be added to form a sample of the final complex signal is of the order of 200, and the time available for calculating each elementary sample is greater than 200 nanoseconds, which is quite compatible with existing technology.

The polyphonic musical instrument according to the invention comprises:

At least one device calculating a sample of a periodic, e.g. sinusoidal, function from a sample of its phase. The device can e.g. comprise a store containing successive samples of the sinusoidal or other periodic wave form. The wave form is stored as a series of binary words, each word representing the amplitude or increment in amplitude at a series of points at which the wave form is sampled. The phase samples applied to the store thus serve as an address for extracting the corresponding amplitude samples;

A device for synthesizing samples of 12 or 13 note signals having the frequencies $f_i$ (i being a number between 0 and 12), where $f_1$ are the frequencies of the 12 or 13 notes of the lowest octave which the instrument can produce;

One or more manual keyboards and, if required, a pedal board or any other note-selecting device serving as an interface between the musician and the instrument. Each key or pedal is used to close a note switch or contact. Of course, use can be made of any device producing an electric signal as a result of an action;

A device for selecting sets, i.e., preselecting the number and amplitude of the harmonics (including the fundamental) in the spectral composition of each played note. The number of selection devices can be equal to the number of keyboards;

Note attack and extinction control means associated with the keyboards and the set preselection device and acting on the amplitude of the calculated note samples, and A scanning and sample calculating device comprising a set of 3 counters. The first or note counter determines the number of the note played in the lowest octave of the instrument. It produces simultaneous scanning of all the notes of the same name on the instrument, e.g. all the C's and all the C sharps, then all the D's, etc. As soon as the closure of a note contact is detected, it selects a note signal sample corresponding to the selected note. The note counter then stays in the same position so that the other two counters can operate. Next, the second or octave counter scans the successive octaves of the note detected by the note counter. As soon as an octave n is detected, the previously selected sample is multiplied by $2^n$ and the octave counter stops so that the third counter can operate. The third or harmonics counter scans the set selection means. At each preselected harmonic of rank h and amplitude k, the preceding sample is multiplied by h then applied to the sinusoidal sample calculating device. Next, the sample is multiplied by the amplitude coefficient k and added to the previously-calculated samples in a cumulative register. When all the harmonics of an octave of the same note have been calculated, the octave counter scans the other octaves, which have been selected in the same manner. When all the octaves have been scanned, the note counter scans the other notes in the same manner. Finally, when all the notes have been scanned, the sum of all the calculated samples is transferred to a numerical/analog converter and then amplified. The contents of the cumulative register is reset to zero and the counters begin a new operating cycle.

Consequently, the duration of the calculating cycle is variable and depends on the number of notes which the musician selects on the manual and pedal keyboards.

BRIEF DESCRIPTION OF THE DRAWINGS

Other features and advantages of the invention will be clear from the following description, which is illustrated by drawings of a non-limitative embodiment of a polyphonic instrument according to the invention. In the drawings.

DESCRIPTION OF THE PREFERRED EMBODIMENT

The following description refers to a preferred embodiment of a polyphonic musical instrument according to the invention. The details of the embodiment set out hereinafter are given by way of non-limitative example only to illustrate the general principle of the invention, as defined in the claims.

Figure 1:
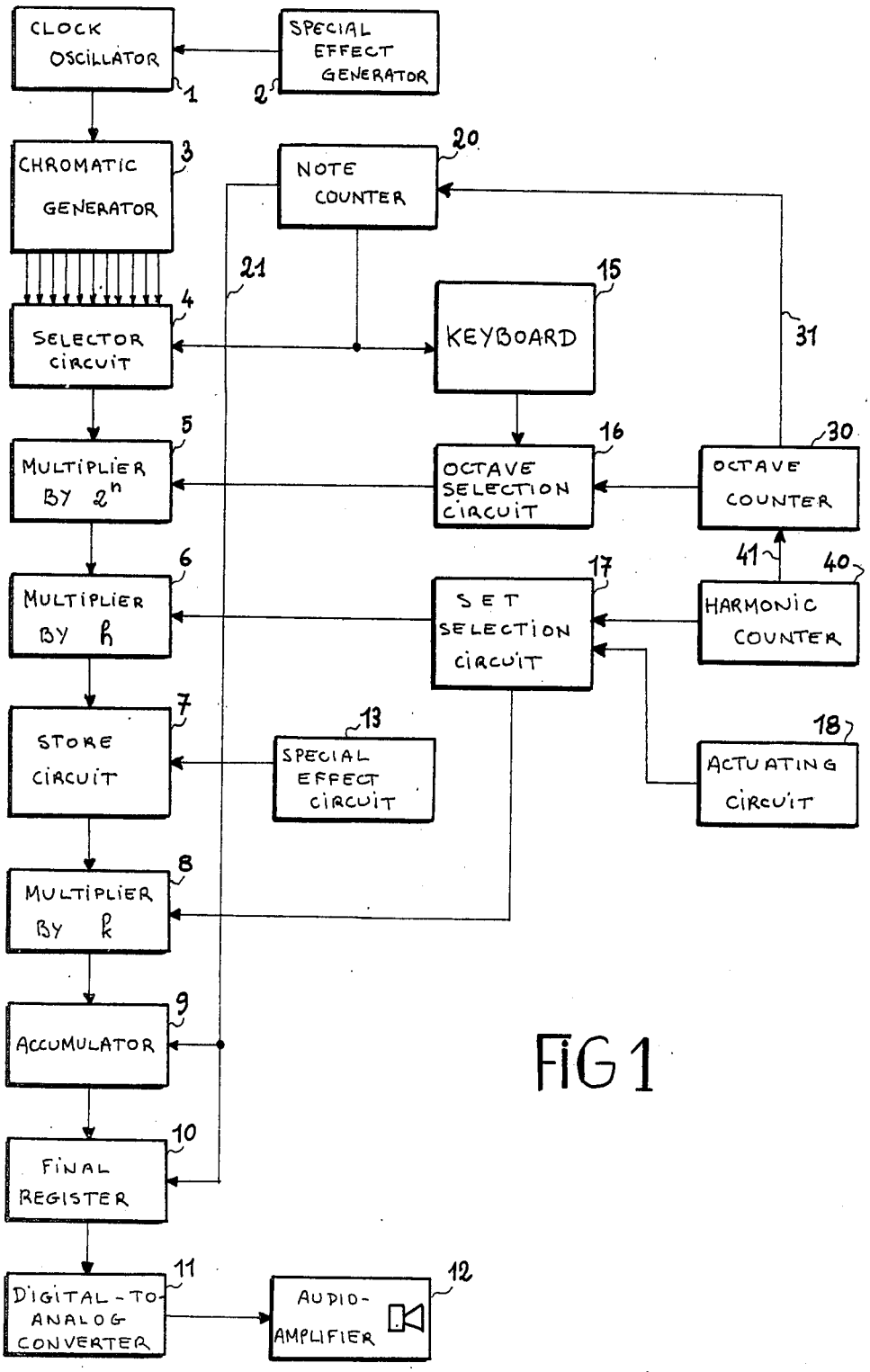
FIG. 1 shows the general structure of the instrument according to the invention.

FIG. 1 is a general synoptic diagram of such an instrument. By way of example, the instrument is an electronic organ having one or two four-octave keyboards, for example, and a pedal board if required. The musician selects a note by pressing a key or pedal. Of course, any other form of instrument is possible, provided that the selection of one or more notes by the musician is represented by the closure of one or more corresponding switches.

In addition to the manual keyboard, the pedal boards or other note actuation means, the instrument comprises timbre or set selection means for imitating conventional non-electronic instruments or producing novel sounds. The instrument can also comprise means for producing special effects, e.g. by varying the frequency of the notes (vibrato effect) or the amplitude of the harmonic components of the sounds (e.g. percussion, contracussion, delay, sustain, etc). Other special effects which can be obtained by an instrument according to the invention will be set out and described hereinafter.

The instrument is entirely numerical. All the signals are produced in numerical form, until they reach a numerical-analog converter 11. The signals applied to converter 11 are successive samples of a complex signal which, after analog conversion, is amplified and propagated by an amplifier and loudspeaker unit 12. The renewal rate of the samples is substantially equal to or twice the highest frequency which the instrument can reproduce.

Since the instrument is polyphonic, each sample applied to the converter is the algebraic sum of the different samples corresponding to each played note, and to each harmonic in the spectral composition of each note.

Each played note is defined by its name, i.e., C, C sharp, D, . . . , B, . . . , and by the number of the octave in which it occurs. For example, $C_3$ is the note C in the third octave. Its fundamental frequency is $2^3=8$ times that of the lowest C which the instrument can play. Each played note, therefore, can be associated with a pair of numbers (i, n) characterizing its fundamental frequency. The number i is between 0 and 12 and corresponds to the position of the note in the lowest octave, and the number n is between 0 and 3 in the case of a 4-octave keyboard and shows the octave containing the played note.

The production of the fundamental frequency of the played note is not sufficient to produce different tones, so that the timbres of the played notes can imitate that of known or imaginary instruments. The fundamental frequency must be accompanied by a certain number of harmonics. If there are 15 harmonics, practically any timbre can be obtained. We shall therefore limit ourselves to this number in the description of the present embodiment.

Accordingly, a played note is the sum of a fundamental frequency and its successive harmonics. Let h denote the rank of the various harmonics, h being between 1 and 15. The fundamental frequency is then denoted by the three numbers (i, n, h=1) and the subsequent harmonics by (i, n, h), h being between 2 and 16. In addition, each frequency has a corresponding amplitude k (h).

Thus, each spectral component of a played note can be written as follows:

$$F_{(h)}=K_{(h)}\sin\,(h2^n\omega_i t)$$

where $\omega_i$ is the instantaneous pulsation of the fundamental frequency of the $i^{th}$ amplitude and t is the instant of sampling.

Consequently a played note can be written as follows:

$$N_{(i,n)} = \sum_{h=1}^{h=16} K_{(h)} \sin(h2^n\omega it)$$

This expression depends only on i and n, i.e. on the chosen note. Since the instrument is polyphonic, a number of notes can be produced simultaneously. Consequently, each sample applied to converter 11 is equal to the sum of the samples of the different notes, each of the latter samples being equal to the sum of the samples of the different harmonics (including the fundamental if required) with their associated amplitudes:

$$R = \sum_{i=0}^{12} \sum_{n=0}^{3} \sum_{h=1}^{16} K_{(h)} \sin(h2^n\omega it)$$

The polyphonic musical instrument according to the invention obtains this triple sum of samples. By means of a note counter 20, its scans the 13 notes of each octave of the manual keyboard or keyboards 15 and/or the pedal board and, for each value of i, determines the sample of the phase $\omega_i t$ by means of a set of circuits 1–4 which will be described hereinafter:

Whenever a key or pedal is pressed, the selected phase $\omega_i t$ is multiplied by $2^n$, n being the number of the octave corresponding to the key, then by $h=1$ if the fundamental of the note has to be played. At the value $h2^n\,\omega_i t$ a store circuit 7 causes a sample to correspond with its sine, which is then multiplied by the corresponding amplitude of the fundamental k(1) and stored in a cumulative circuit 9.

The same operation is immediately repeated for the other harmonics of the same note, each newly calculated sample being added to the preceding samples in (9) after which the operation is performed in the case of the other notes having the same name (same value as i) but in higher octaves n and finally in the case of the other notes having a different value i.

As soon as the various samples have been added, the contents of the cumulative circuit is transferred to a final register 10 connected to a numerical-analog converter 11. Next, the contents of circuit 9 is erased and the manual keyboard or keyboards and pedal board are scanned again, with a new accumulation of samples.

It is important to understand that the different samples of the different harmonics of the different octaves of the different notes are not produced systematically at all values of i, n and h, since the resulting calculation time would be much too long and unsuitable for producing high frequencies of the order of 6–10 kHz.

According to a feature of the invention, the time for calculating the final sample applied to the converter is substantially proportional to the number of played notes. Thus, if no notes are played at certain values of i and n, the instrument does not waste time on these notes and takes account only of notes which are played in fact.

In practice, the maximum number of notes which can be simultaneously played on the instrument by a single musician is 11 or 12 and a number of these 12 notes will bear the same name (same i) but be at different octaves. The time for calculating the final sample can be reduced to a minimum by judicious scanning of the set of keyboards 15 and by a likewise judicious choice of the order in which the operations are to be performed.

Before studying the order of operations in greater detail (FIG. 2) we shall examine the various components and circuits forming the instrument and shown in FIG. 1.

The instrument is based on a clock oscillator 1 associated with a circuit 2 for generating special effects. The generator produces e.g. a very low-frequency sinusoidal signal which modulates the frequency of oscillator 1 to obtain a vibrato effect.

The oscillator is coupled to a chromatic generating circuit 3 which, on the basis of the clock signal, delivers 13 signals having frequencies distributed to match the successive semitones of an octave. The ratio between two consecutive frequencies is $2^{1/12}$. A generator of this kind is commercially available, i.e., MOTOROLA Reference MK 50240 or SESCOSEM, reference SFF 5009. It can replace a set of 13 independent oscillators and has the additional advantage that the 13 notes, which are directly produced from the circuit, are tuned indefinitely. The organ as a whole is tuned simply by adjusting the frequency of oscillator 1 — i.e., frequency transposition effects can easily be obtained.

The 13th semitone of the generator is allocated to the last note of each manual or pedal keyboard. The 13 signals of generator 3 are applied to a counter and selector circuit 4 actuated by a note counter 20 at the same time as the set of keyboards is being scanned. Circuit 4 behaves like a set of 13 counters, the contents of which are regularly and independently increased by the signals of the chromatic generator, and also behaves like a 13-position switch selecting the contents of the $i^{th}$ counter as the sample of the instantaneous $\omega_i t$ phase of note i when pressure is detected on the key for the note i.

The $\omega_i$ t sample is transmitted to a multiplying circuit 5 actuated by an octave selection circuit 16 associated with the set of keyboards 15. The sample is also transmitted to an octave counter. If the pressed key or pedal corresponds to a note having the name i and in the octave n, the octave counter 30 successively scans the octaves of note i and, as soon as pressure is detected on the key in octave n, the value of n is transmitted to circuit 5, which multiplies the sample by 2n, i.e., the binary word is shifted by n bits towards the left. In practice, the operation can be performed in a slightly different manner.

The octave counter, via the octave selector 16, produces a shift of 1 bit towards the left whenever its contents is increased by 1 unit. However, the result of the operation is not transmitted to the following circuit unless the octave selector has detected pressure on a key or pedal.

The next circuit (6) multiplies by h, the rank of the harmonic in the spectral composition of the note.

The number of harmonics (including the fundamental) and their respective amplitudes are determined in advance by the musician for all notes of the same keyboard. In other words, the set or the timbre is the same for all the notes of the same keyboard, but may be different in another keyboard or in the pedal board. Of course, there may be several preselectable sets per keyboard, but the musician can select only one at a time for each keyboard. However, in a cheap organ containing only one keyboard, part of the keyboard can be separate from the rest and different sets can be obtained in the two parts. The set can be contained in a mains-only store having 16 states and read by means of a harmonics counter 40 which, at each value of h, extracts from the store that amplitude $k_{(h)}$ by which the obtained sample will be multiplied after the sine has been calculated.

Alternatively, the set can be in the form of harmonic pull handles or pull knobs, or a set of 16 step switches for simultaneously displaying the existence and amplitude of a harmonic. Details of such sets will be given hereinafter. Special effects such as percussion, sustain or contracussion can be produced by an actuating circuit 18 coupled to the harmonic handles or knobs. If the sets are preselected and stored, the special effects can also be stored and be independent for each harmonic.

If a harmonic of rank h exists, the sample of phase $2^n\omega_i t$ delivered by multiplier 5 is multiplied by h in multiplier 6.

The value of sample $2^n\omega_i t$ is then used as the address of a read-only store 7 in which samples of a sinusoidal or any other periodic function are recorded. Accordingly, the store matches sample $h2^n\omega_i t$ with another sample corresponding to the instantaneous value of sin $(h2^n\omega_i t)$.

A multiplying circuit 8 multiplies the last-mentioned value by the preselected amplitude of the harmonic h, after which the result is added to the contents of the cumulative circuit 9.

A special effects circuit 13 can be associated with store 7 to obtain phase-shift or Boppler effects, commonly called "LESLIE" or "glissando", effects.

Circuit 9 is followed by a final register 10 in which the contents of circuit 9 is transferred after all the samples of all the harmonics of all the played notes have been successively added.

The numerical-analog converter 11 then transmits the analog value of the complex signal sample to the low-frequency portion of instrument 12.

When the 16 harmonics of the preselected set have been scanned, i.e., when the harmonics counter 40 has travelled through a complete cycle, a connection 41 indicates that octave counter 30 has been moved forward by one unit.

Similarly, when the octave counter 30 has moved through a complete cycle, a connection 31 moves the note counter 20 forward by one unit.

Finally, when the scanning cycle of the set of manual and pedal keyboards is complete, a connection 21 transfers the contents of circuit 9 to register 10, then resets the contents of circuit 9 to zero.

Figure 2:
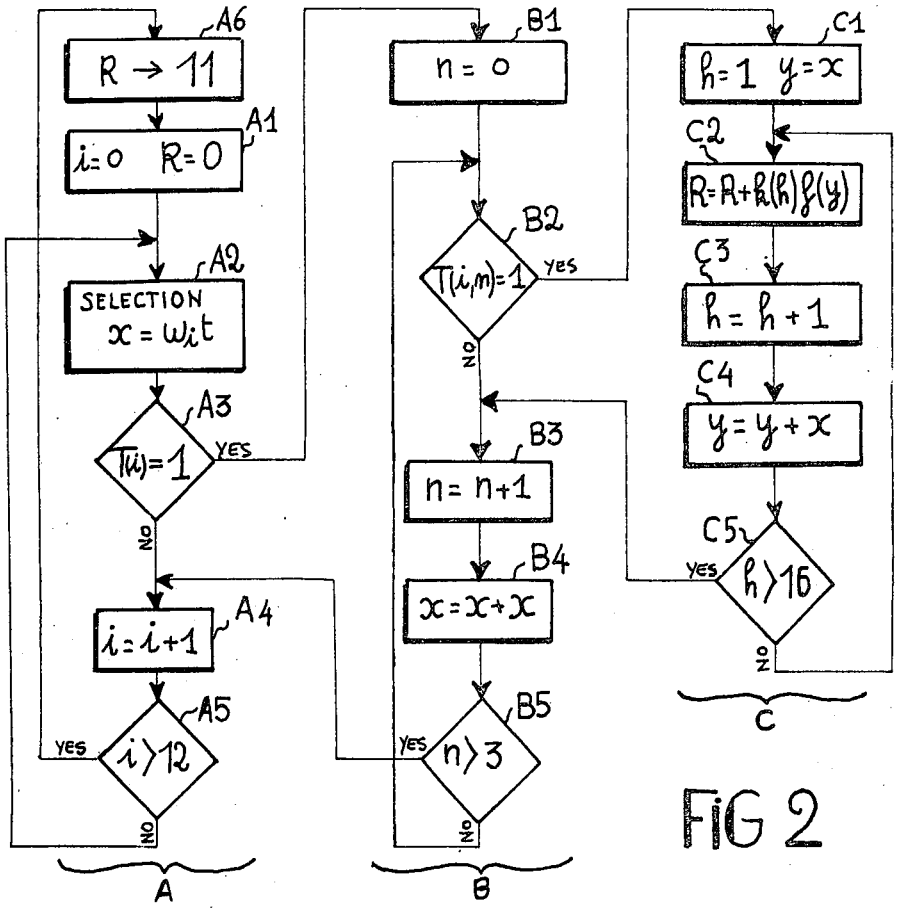
FIG. 2 is a flow chart showing the operation of the instrument.

The control and operation of the instrument will be more clearly understood from referring to the flow chart shown in FIG. 2.

The flow chart is made up of three successive parts, i.e., a part A related to the operation of the note counter 20, a part B for the octave counter 30 and a part C for the harmonics counter 40.

The various instructions for part A comprise the following:

A1. At the beginning of a complete cycle for calculating a sample of the complex output signal, counter i 20 is reset to zero and the contents of circuit 9 is erased.

A2. The selection circuit 4 selects the value of sample $x=\omega_i t$ for one of the 13 semitones of the lowest octave in the instrument. At the beginning of the cycle, the selector first chooses note C, for example (i=0), then the other notes (up to i=12).

A3. Since the note counter 20 is also connected to the set of manual and pedal keyboards, the counter also detects whether a key has been pressed corresponding to the valve of i in question. $T_{(i)}=1$ if a key having the name i has been pressed in any octave. If this is the case, a transition is made to instruction B1. If not, i.e. $T_{(i)}=O$, there is a transition to the next instruction of part A.

A4. In the case where $T_{(i)}=0$, counter 20 is moved forward by one unit: i=i+i.

A5. The state of counter 20 is checked. If $i \leqq 12$, a return is made to instruction A2 so as to determine the new value of $x=\omega_i t$ corresponding to the next note i+i. If $i>12$, the cycle restarts from the beginning after instruction A6.

A6. This is the final instruction. When all the notes, all the octaves of these notes and all the harmonics have been calculated and added, the contents R of circuit 9 is transferred to the final register 10 and the numerical-analog converter 11.

B1. The first instruction of part B is operative when pressure on a key having the name i is detected. The octave counter 30 is then reset to zero.

B2. The octave selector 16, actuated by the octave counter 30, determines whether a key having the name i in octave n has been pressed. Since there must be at least one value of n for which the condition $T_{(i,n)}=1$ is true, the instructions are looped until this condition is fulfilled, in which case the next instruction is Cl, i.e., scanning of the set. Until condition $T_{(i,n)}=1$ has been fulfilled, i.e. as long as $T_{(i,n)}=0$, the subroutine B continues via B3.

B3. the octave counter is moved forward by one unit.

B4. The value of the sample $x=\omega_{11}{}_i t$ is multiplied by two since it corresponds to the upper octave. This multiplication occurs automatically whenever the octave counter 30 is moved forward by a unit, even when $T_{(i,n)}=0$. Thus, when $T_{(i,n)}=1$ for a value of n, the contents of multiplier 5 can be transferred to multiplier 6.

B5. The value of n is checked. If the value of n is less than or equal to the total number of octaves covered by the instrument (n=3 in the example of FIG. 2), the next instruction is B2. Otherwise, a return is made to instruction A4 since all the octaves of note i have been scanned and the samples calculated.

C1. The harmonics counter 40 is set to unity and the value x of the sample determined in part B is transferred to the subsequent circuits 6, 7, 8, 9 to calculate the various samples of the harmonics.

C2. At a given value of h, x is transferred to circuit 6, where it becomes y. The value of y is used as an address for store 7, which delivers f (y)=sin (y) or another periodic function. Next, f (y) is multiplied by the amplitude coefficient k (h) of harmonic h. The result is added to the existing contents R of the cumulative register 9.

C3. The harmonics counter is moved forward by one unit.

C4. The contents x of the multiplier 5 is added to value y to obtain the successive values of y=hx.

C5. Finally, the value of h is checked to find out whether all the harmonics in the set have been scanned. If this is the case, i.e., h>16, part B is resumed from instruction B3 so as to scan the subsequent octaves. Otherwise, the sample of the next harmonic is calculated by means of instruction C2.

As can be seen, a sample can not be calculated unless the following two conditions are satisfied: $T_{(i)}=1$ and $T_{(i,n)}=1$. Consequently, samples are calculated only when keys are actually pressed. In the case of the other keys, parts A and B carry out empty cycles very quickly.

In FIG. 2, the transition from C5 to B3 corresponds to the connection 41 in FIG. 1. Similarly, the transition from B5 to A4 corresponds to connection 31 and the transition from A5 to A6 to connection 21.

Figure 3:
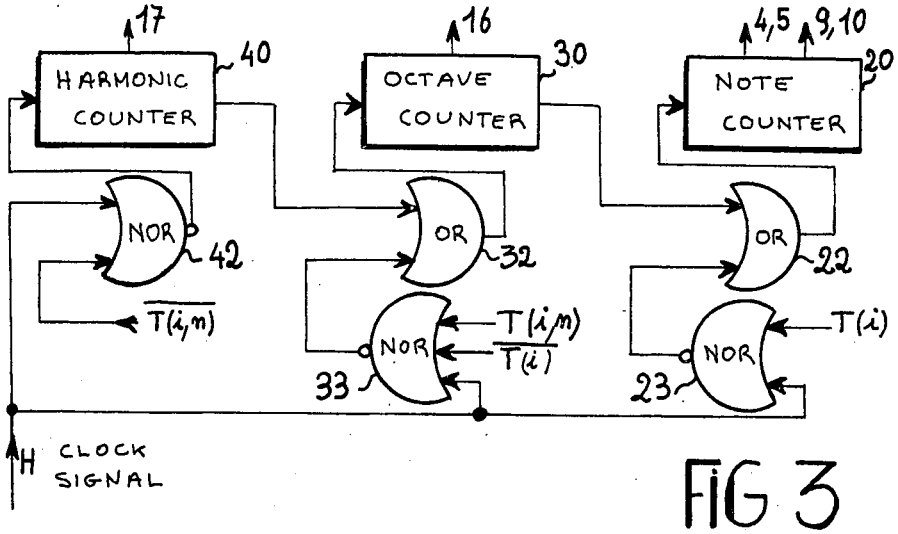
FIG. 3 shows how a set of note, octave and harmonics counters is connected.

FIG. 3 shows the detailed connections of counters 20, 30 and 40, which control the general operation of the instrument.

A clock signal H, which is common to all the counters, controls the advance of the program instructions.

The harmonics counter 40 is actuated from a NOR gate 42 which receives the clock signal H and also receives the signal $T_{(i,n)}$, which is the conjugate of signal $T_{(i,n)}$. Thus, when a key is detected and $T_{(i,n)}=1$, counter 40 is moved forward by 0 to its maximum value, at the same rate as the signals from clock H. Counter 40 is connected to the set selector 17 which, actuated by counter 40, reads out the preselected data for calculating the samples of the various harmonics of the note (i, n).

When the contents of counter 40 has been finished, a pulse is produced and, via an OR circuit 32, moves forward the octave counter 30 via one unit. Counter 30 is also actuated from a NOR gate 33 which receives the clock signal H, the signal $T_{(i)}$ and the signal $T_{(i,n)}$. When $T_{(i,n)}=1$, counter 30 remains inoperative and only counter 40 can count. However, when $T_{(i,n)}=0$ and $T_{(i)}=0$, counter 30 is moved forward by signal H until the condition $T_{(i,n)}=1$ is satisfied.

The note counter 20 is actuated in the same way, i.e., it can be moved forward either when an OR circuit 22 shows that the octave counter 30 has been exceeded, or by the clock pulses H when $T_{(i)}=0$, by means of a NOR circuit 23 receiving H and $T_{(i)}$.

Counter 30 actuates selector 16 and counter 20 actuates selector 4 and the set of keyboards 15. In addition, the information that counter 20 has been exceeded is used for transferring the final sample of circuit 9 to register 10 and converter 11, and reset the cumulative circuit 9 to zero.

Figure 4:
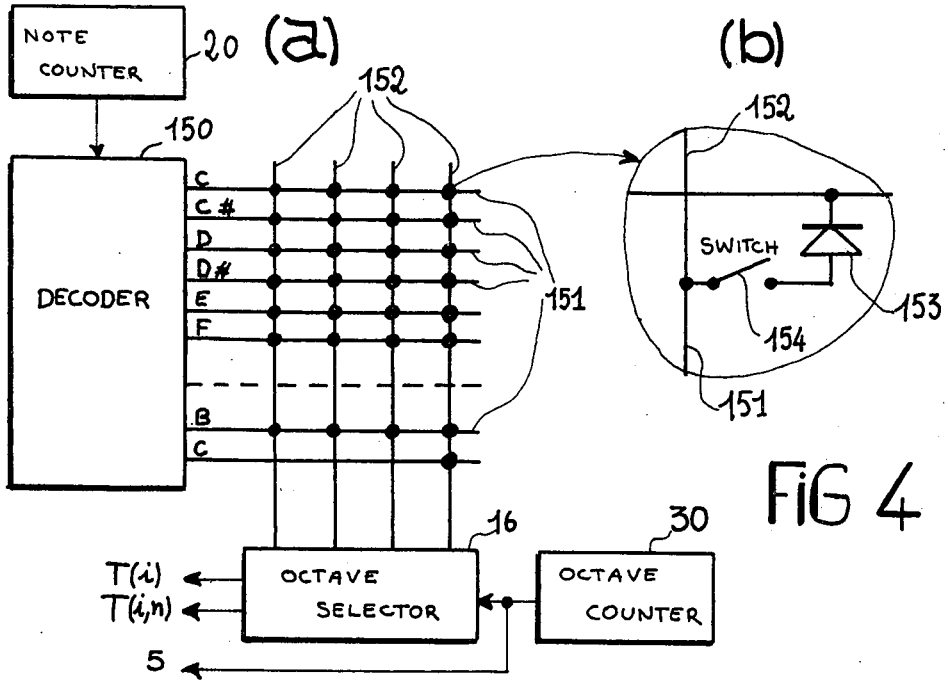
FIG. 4 shows an example of a keyboard (a) and a detail of a key contact (b)

FIG. 4 shows an embodiment of the set of manual and pedal keyboards 15. For the sake of clarity, the drawing shows only one four-octave keyboard plus one note. The device comprises a decoder 150 which receives the contents of note counter 20 and has 13 outputs, one of which is in a different state from the 12 others. The 13 outputs are connected to 13 conductors 151 which intersect 4 conductors 152. At each intersection, lines 151 and lines 152 are interconnected by a diode 153 in series with a switch 154. Switches 154 are associated and actuated by the keys on the keyboard. The 4 lines 152 are connected to an octave selector 16 connected to octave counter 30. The octave selector 16 delivers actuating signals $T_{(i)}=1$ when any of the switches 154 is closed on the line 151 corresponding to the note i, $T_{(i,n)}=1$ when the switch at the intersection between the line 151 corresponding to note i and the line 152 corresponding to the octave n is closed. The signals are used for successive multiplying by 2 to obtain the sample $2^n\omega_i t$.

The keyboard can be of any suitable kind—e.g. similar to a piano keyboard as in an electronic organ, in which case each switch 154 is associated with and actuated by a key. However, other embodiments are possible, e.g. an accordion or other instrumental keyboard.

This kind of keyboard has a considerable advantage with regard to the number of connections required between the keyboard and the other circuits. It is only necessary to connect each diode 153 directly to the associated switch, and the only other connections are the 13 wires to decoder 150 and the 4 wires to selector 16, i.e., a total of 17 connecting wires for a keyboard having 49 keys (4 octaves plus one note). Furthermore the 13th wire of decoder 150, which corresponds e.g. to the top C, is connected only by a diode 153 and switch 154 to that wire of selector 16 corresponding to the 4th octave.

These are the only connections required for the polyphonic musical instrument according to the invention. Since the number of connections is small, the manufacturing cost can be substantially reduced.

Consequently, in the case of an instrument comprising a pedal board having 13 pedals and two 4-octave manuals, the total number of connecting wires will be 13+1+8=22, which is very small, considerably less than in a conventional instrument of similar kind.

The number can be further reduced if the decoder forms part of the set of manual and pedal keyboards.

Figure 5:
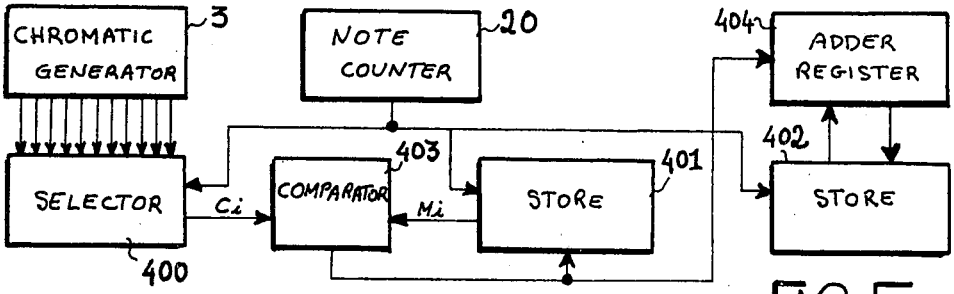
FIG. 5 shows a circuit for calculating phase samples.

FIG. 5 shows an example of the counter and selector circuit 4. This circuit is adapted to generate sample values $x=\omega_i t$. This could be achieved by 13 independent counters and a selector choosing the contents of one of them. It is much more economic, however, to construct the counter-selector unit as shown in FIG. 5.

A selector 400 actuated by the note counter chooses one of the signals $C_i$ delivered by the chromatic generator 3. In a store 401, counter 20 selects the value $M_i$ of the signal $C_i$ during the preceding cycle. A comparator circuit 403 compares the states of $C_i$ and $M_i$. If the states are different, comparator 403 brings about a change of state of $M_i$ such that $C_i=M_i$, and the state of the $i^{th}$ number in store 102 is moved forward by one unit. For this purpose, an intermediate register 404 receives the number $x=\omega_i t$ from the preceding cycle, adds one unit by action of the comparator circuit 403, and writes the new value of $\omega_i t$ in store 402.

Figure 6:
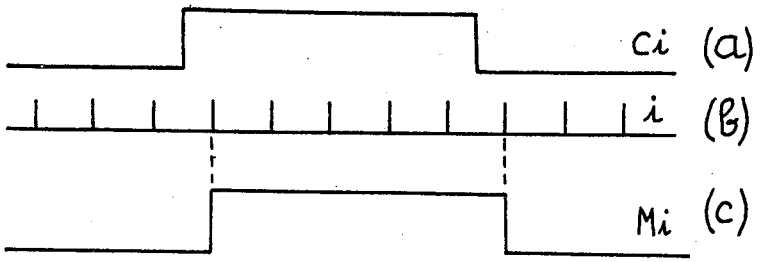
FIG. 6 shows signals produced in the calculating circuit.

Store 401 has 13×1 bits so as to contain the 13 possible states of $M_i$ corresponding to the 13 signals $C_i$ delivered by the chromatic generator. Stores $M_i$ eactly follow the variation in signals $C_i$, after a short delay. By way of example, FIG. 6 shows a given signal $C_i$ at (a)

and control pulses at (b) delivered by counter 20 when it indicates the value i. At (c), FIG. 6 shows the state of the corresponding store $M_i$ in circuit 401. Its state changes at the same time as pulse i, which immediately follows any change in state of $C_i$. Only these changes of state are counted in the corresponding store $\omega_i t$ in circuit 402. Circuit 402 is a store containing e.g $13\times 8$ bits, i.e., at each instant it contains the 13 values of $x=\omega_i t$ for the 13 values of i. Consequently, a value of x is selected in store 402 at each position of counter 20, and the value is transferred to the multiplier circuits 5 and 6.

Store 402 need not necessarily have 8 output bits. This number is dependent on the accuracy with which it is desired to reproduce the signals from the instrument, and by the frequency of the lowest note which the instrument can produce. Incidentally, since the address controls of stores 401 and 402 are identical, they can be physically combined in a single circuit.

Next, the multiplying circuit 5 calculates the sample of the fundamental of a note (i, n). Store 402 delivers samples of the notes of the lowest octave of the instrument (n=0). As we have seen, the value of the sample of the fundamental note played (i, n) is $2^n\omega_i t$. In the case of an instrument having 2 keyboards, the fundamental note is obtained by multiplying $\omega_i t$ by $2^n$ on one keyboard and by $2^{n-3}$ on the other keyboard, for example.

Actually, multiplication by $2^n$ is carried out in stages at the same time as the octave counter moves forward, either by successive shifts of 1 bit to the left or by successive additions of $\omega_i t$ as shown in FIG. 2.

Similarly, the samples of harmonics $h2^n\omega_i t$ are calculated in stages at the same time as the harmonics counter moves forward. Consequently, the multiplication is brought about by h succesive additions $2^n\omega_i t$.

The fundamental note or notes of the instrument are obtained in the read-only store 7. If the fundamental note is a sinusoidal function, it is sufficient to code a quarter-period in the store, since the rest of the function can be deduced by symmetry. In store 7, the triangular signals delivered by the calculating circuits are converted into a sinusoidal function. These signals are triangular because they are produced by regular moving forward of the counters.

Consequently, the read-only store can be omitted from a cheap model, where the production of triagular signals is adequate.

Similarly, an even cheaper instrument can be provided in which harmonics are not calculated but a number of fundamental notes are coded in the read-only store.

Some special effects can be obtained by temporarily modifying the value of the samples applied to store 7.

Figure 7:
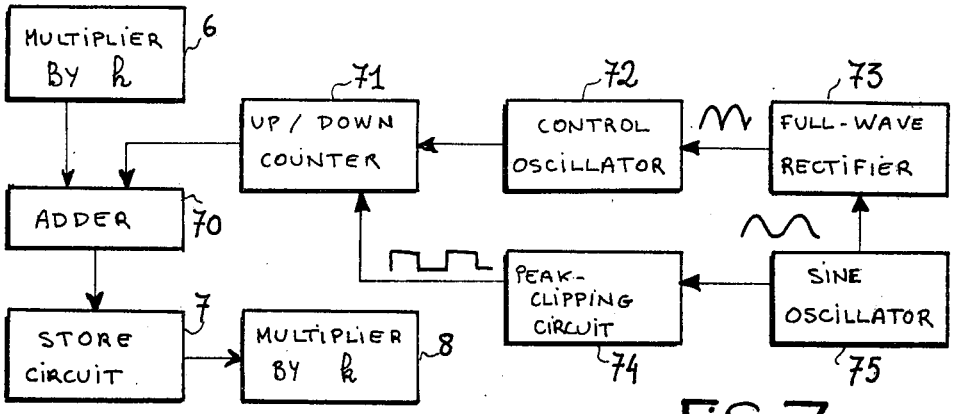
FIG. 7 shows a circuit for generating special effects.

An example of such special effects is shown in FIG. 7.

The effect imitates the Doppler effect produced by mechanical rotation sin Ω t) loudspeakers. This is commonly called the "LESLIE" effect. It is obtained by adding the function jt sin Ω t to the value of each sample for store 7, Ω corresponding to a few periods per second and j being a coefficient defining the amplitude of the desired effect.

Consequently, the value of the samples at the output of store 7 is:

$$v_o \sin (h2^n\omega_i t + jt \sin\Omega\, t)$$

where $v_o$ is a constant depending on the value of the samples coded in the store.

When Ω is a constant, the signals produced by the instrument give the impression of being transmitted by a loudspeaker moving in a circle while the observer remains at rest.

This effect is obtained by inserting an adder 70 between multiplier 6 and store 7. The normal sample $h2^n\omega_i t$ is applied to one input of adder 70 and the value jt sin Ω t is applied to the other input.

The value jt sinΩ t is obtained at the output of a forward and backward counter 71 receiving forward or backward counting pulses from a voltage frequency control oscillator 72, together with an instruction relating to the direction of counting. The frequency of oscillator 72 is controlled by a sinusoidal oscillator 75 followed by a full-wave rectifying circuit 73. The direction of counting of counter 71 is determined by the high level or the low level of the rectangular signal delivered by a peak-clipping circuit 74 connected to oscillator 75.

The intensity of the effect depends on the deviation of oscillator 72. The "speed of rotation" of the effect is determined by the frequency of the sinusoidal oscillator 75.

Figure 8:
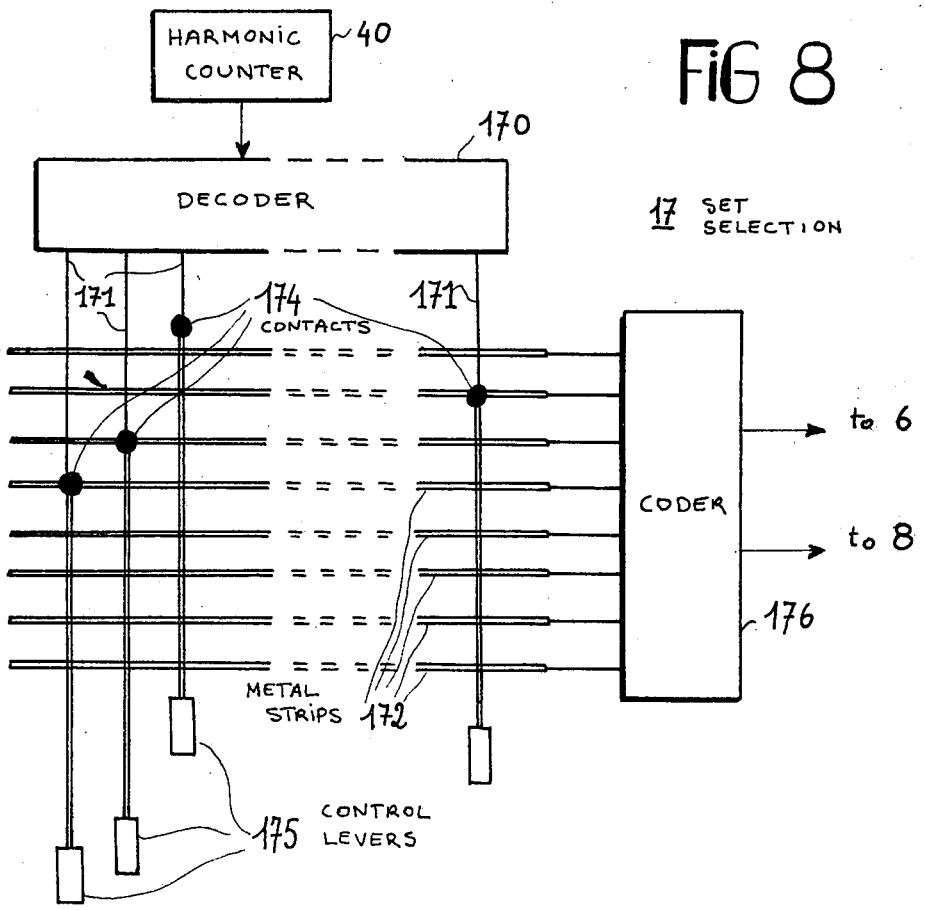
FIG. 8 shows an embodiment of the set selector.

FIG. 8 shows an embodiment of a set selector 17. The selector comprises a number of harmonic pull handles or knobs and sliding contacts or step switches for preadjusting the number and amplitude of the harmonics occurring in the spectral composition of the sound emitted by the instrument.

In the present example, the number of handles is 16. The first handle (h=1) corresponds to the fundamental note and the other handles correspond to the harmonics 2 (h=2), 3 (h=3), . . . 16 (h=16).

Each handle comprises a control lever 175 for placing the contact 174 on one out of 8 conductive metal strips 172. Each strip 172 corresponds to an amplitude value. The ratio between the amplitudes of any two consecutive strips is 6 dB. Consequently, each handle has 9 positions and can be used to adjust the amplitude of a harmonic h in stages of 6 dB from 0 to −42 dB at the first 8 positions, the level being totally extinguished in the last position.

The set of handles is connected to the instrument via a decoder 170 connected by connections 171 between the harmonics counter 40 and the 16 handles, and via a coder 176 which delivers two kinds of information: i.e., it detects the non-existence of each harmonic and also detects the amplitude of the harmonic.

Each state of counter 40 is used to select a handle by action of decoder 170. The signal delivered by the decoder at the handle in question is used to obtain the first information, if the moving contact 174 has not been placed on one of the conductive strips 172. The consequent absence of a signal results in a multiplication by 0 in multiplier 8. If contact 174 has been placed on one of the strips 172, the signal appearing at the input of coder 176 is used to multiply the samples of the sinusoidal function obtained by $2^{-A}=k$, A being the number corresponding to the conductive metal strip which is in contact with the moving contact 174.

The same process is repeated in succession for all the handles and all the positions of counter 40.

Of course, each handle can be replaced by a step switch having 8 or 9 positions obtained by moving in a straight line or a circle. In that case, strips 172 will be replaced by connections whereby the various fixed contacts of the switches are connected to one another and to coder 176.

Figure 9:
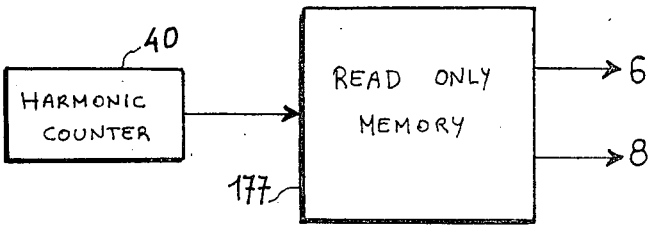
FIG. 9 is a variant of the set selector.

The unit comprising decoder 170, the handles and coder 176 can be replaced by a read-only store 177 as shown in FIG. 9. The store is programmed to contain a preselected set. At each value of h, it delivers information showing the presence of the harmonic and the amplitude for multiplier 8. A number of stores such as 177 can be programmed and selected in turn by corresponding switches, so that the instrument can imitate various different timbres.

Furthermore, one or more read-only stores can be associated with the set of handles so as to store a particular set which the musician has discovered. The effect of the preselected handles or sets or of the stores can be summed by conventional methods of addition.

Besides choosing the number and amplitude of the harmonics occurring in the spectral composition of the sounds produced by the instrument, the set selector 17 can be associated with means for controlling the variation in time of the amplitude of each harmonic. Such means can increase the sound possibilities of the instrument, by supplementing the timbres by transitory effects for imitating real instruments.

Figure 10:
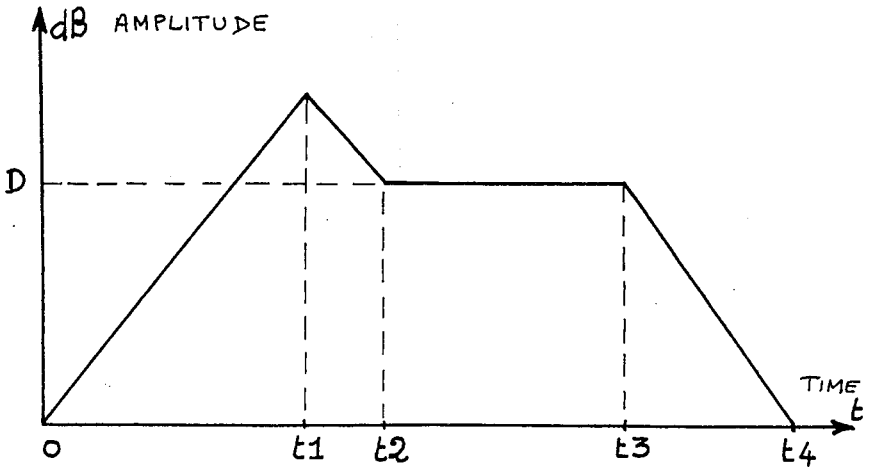
FIG. 10 is a graph showing the variation in time of the amplitude of a note harmonic.

FIG. 10 is a graph of the amplitude of each harmonic, in dependence on time. The instance 0 is the instant when the key is pressed. Between instants 0 and $t_i$, the amplitude of the signal increases from the level −42 dB to the level 0 dB, even if the amplitude displayed by the handle is at an intermediate level. Between the instants $t_1$ and $t_2$, the amplitude decreases to the level D displayed by the handle. Between the instants $t_2$ and $t_3$, $t_3$ being the instant when the key is released, the level remains constant. Finally, between the instants $t_3$ and $t_4$, the signal decreases to total extinction.

In practice, a large number of instruments can be imitated by varying the time intervals $0$–$t_1$, $t_1$–$t_2$ and $t_3$–$t_4$, in an independent manner for all the harmonics. However, to avoid an excessive number of control knobs, a given number of effects can be programmed in advance in a store.

The various effects are obtained by inserting a variable-gain circuit and a gain control circuit between coder 176 and multiplication circuit 8. The response, in dependence on time, of the gain control circuit is shown by FIG. 10.

If required, the gain control circuit can contain a low-frequency oscillator to introduce amplitude modulation in the sound produced and obtain a "tremolo" effect.

What is claimed as new and desired to be secured by letters patent of the United States is:

1. A polyphonic electrical musical instrument comprising a device for calculating instantaneous amplitudes at selected sampling points of a periodic function on the basis of corresponding instantaneous phase amplitudes, a device for synthesizing instantaneous phase amplitudes of 12 or 13 note signals at frequencies distributed in accordance with the semitones of an octave, a set of keys and pedals for selecting the notes played by the instrument, and a device for scanning the keys and pedals and simultaneously calculating the note signal instantaneous amplitudes, the scanning device comprising a note counter for determining the name of a note played in any octave and simultaneously selecting a corresponding instantaneous phase amplitude at the output of the synthesis device, an octave counter for determining the number n of the octave containing the played note, a multiplier coupled to said octave counter for multiplying the selected phase amplitude by $2^n$ and applying it to the calculating device, and means for stopping the note counter when a pressed key or pedal is detected, for causing the octave counter to scan the selected octaves of the note, for calculating the corresponding amplitudes and for allowing the note counter to come into operation again until all the amplitudes of the octaves of the selected notes have been calculated.

2. An instrument according to claim 1, characterised in that it also comprises addition means disposed upstream of the calculating device and receiving each phase amplitude plus an amplitude of a time function equal to the product of a linear time function and a periodic time function.

3. An instrument according to claim 1 including a set selection device for determining the rank h of harmonics to be added to the fundamental of a note, and a third or harmonics counter for scanning the set selecting device and causing the phase amplitude to be multiplied by h before being supplied to the calculating device, h being the rank of the harmonic in question.

4. An instrument according to claim 3, wherein the set selection device comprises means for selecting the amplitude k of each rank h harmonic, and means whereby each amplitude delivered by the calculating device is multiplied by k in synchronism with the harmonics counter.

5. An instrument according to claim 3, including means for actuating the notes, octave and harmonics counters so as to stop the note counter during the scanning of the octaves and the calculation of the corresponding amplitude, stop the octave counter during the calculation of the harmonic amplitudes, restart the octave counter when all the harmonic amplitudes have been calculated, and restart the note counter when all the amplitudes of the octaves of a note have been calculated.

6. An instrument according to claim 3, wherein the set selection means comprise a read-only store connected to the harmonics counter and adapted, at each value of h, to deliver data indicating a presence or absence of the corresponding harmonic and amplitude k.

7. An instrument according to claim 3, wherein the set selection means comprise an active store connected to the harmonics counter and adapted, for each value of h, to deliver data indicating the presence or absence of a harmonic and the corresponding amplitude k.

8. An instrument according to claim 3, wherein the set selection means comprise a decoding circuit connected to the harmonics counter, a set of pull handles or pull knobs connected to the decoder, a coding circuit for delivering data showing the absence of a harmonic and amplitude k, a set of conductors intersecting the handles or knobs and connected to the coding circuit and contacts associated with the respective handles or knobs so as to connect each one of them to one of the conductors.

9. An instrument according to any of claim 8 characterised in that the amplitude control means are associated with the set selection means so as to vary the amplitude of each harmonic in time, in accordance with a given time function.

10. An instrument according to claim 1, including an adding register for adding together all the amplitudes calculated during an operating cycle of the note counter.

11. An instrument according to claim 10, wherein the counter actuating means also functions to bring about the transfer of the contents of the adding register to a final register, then erase the contents of the adding register at the end of each operating cycle of the note counter and before each new cycle.

12. An instrument according to claim 11, wherein the counter actuating means comprise a clock signal generator (H), a first NOR circuit receiving the clock signal (H) and a signal $T_{(i,n)}$, i.e. the conjugate of a signal $T_{(i,n)}$ delivered by the set of manual and pedal keyboards, the output of the first NOR circuit being connected to the counting input of the harmonics counter, a second NOR circuit receiving the clock signal (H), the signal $T_{(i,n)}$ and a signal $T_{(i)}$ likewise delivered by the set of manual and pedal keyboards, a first OR circuit which receives the excess or overshooting signal delivered by the harmonics counter and the output signal of the second NOR circuit and the output of which is connected to the counting input of the octave counter, a third NOR circuit receiving the clock signal (H) and the signal T, and a second OR circuit which receives the output signal of the third NOR circuit and the excess or overshooting signal delivered by the octave counter and the output of which is connected to the counting input of the note counter, the signal $T_{(i)}$ being equal to unity when a note having the name i is selected, and equal to 0 in the contrary case, and the signal $T_{(i,n)}$ being equal to unity when the note having the name i and in octave n is selected, and 0 in the contrary case.

13. An instrument according to claim 12, wherein the set of manual and pedal keyboards comprise a decoding circuit having 13 outputs, the input of the circuit being connected to the output of the note counter, an octave selecting circuit connected to the output of the octave counter, 13 lines connected to the outputs of the decoder, a given number of lines connected to the octave selector and intersecting the 13 lines and, at each intersection between a line and a line, an assembly comprising a switch secured to a key or pedal in series with a diode connected between the two lines.

14. An instrument according to claim 13, wherein detection means are associated with the octave selector to deliver a signal $T_{(i)}=1$ when a switch on the $i^{th}$ line is closed and a signal $T_{(i,\ n)}=1$ when a switch at the intersection of the $i^{th}$ line and the $n^{th}$ line is closed.

* * * * *